US008941490B2

(12) United States Patent
Ky

(10) Patent No.: US 8,941,490 B2
(45) Date of Patent: Jan. 27, 2015

(54) AUTOMATIC LIFE ALARM

(71) Applicant: Albert Ky, Alameda, CA (US)

(72) Inventor: Albert Ky, Alameda, CA (US)

( * ) Notice: Subject to any disclaimer, the term of this patent is extended or adjusted under 35 U.S.C. 154(b) by 135 days.

(21) Appl. No.: 13/791,680

(22) Filed: Mar. 8, 2013

(65) Prior Publication Data

US 2014/0253325 A1 Sep. 11, 2014

(51) Int. Cl.

| | |
|---|---|
| ***G08B 1/08*** | (2006.01) |
| ***G08B 23/00*** | (2006.01) |
| ***G08B 13/14*** | (2006.01) |
| ***G08B 21/04*** | (2006.01) |

(52) U.S. Cl.

CPC ..... *G08B 21/0415* (2013.01)
USPC ..... 340/539.13; 340/539.12; 340/572.1; 340/573.1

(58) Field of Classification Search

CPC ... G08B 21/0261; G08B 21/22; G08B 21/245
USPC ..... 340/539.13, 539.12, 572.1, 573.1
See application file for complete search history.

(56) References Cited

U.S. PATENT DOCUMENTS

| | | | | |
|---|---|---|---|---|
| 6,115,929 | A * | 9/2000 | Tanazawa et al. | 33/366.24 |
| 6,198,394 | B1 * | 3/2001 | Jacobsen et al. | 340/573.1 |
| 7,015,817 | B2 * | 3/2006 | Copley et al. | 340/573.4 |
| 7,081,905 | B1 * | 7/2006 | Raghunath | 345/684 |
| 7,477,890 | B1 * | 1/2009 | Narayanaswami | 455/414.1 |
| 2009/0322513 | A1 * | 12/2009 | Hwang et al. | 340/539.12 |
| 2011/0298613 | A1 * | 12/2011 | Ben Ayed | 340/539.11 |

* cited by examiner

*Primary Examiner* — Jennifer Mehmood
*Assistant Examiner* — Emily C Terrell

(57) ABSTRACT

The life alarm sensor device a very compact life alarm with a geodesic-like convex body frame structure mechanical sensor. The geodesic-like frame sensor is comprises a plurality of polygonal frames with beveled edges which are contiguously coupled at their respective edges with conducting probes, an unconstrained conducting ball dynamic wrist movement following inside the geodesic frame structure that closes a frame electric circuit upon a cessation of wrist movement. An alarm is triggered when a pre-set countdown has elapsed.

8 Claims, 14 Drawing Sheets

Sensor - Plate Pin protrusion with connector
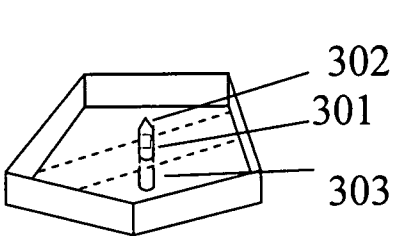
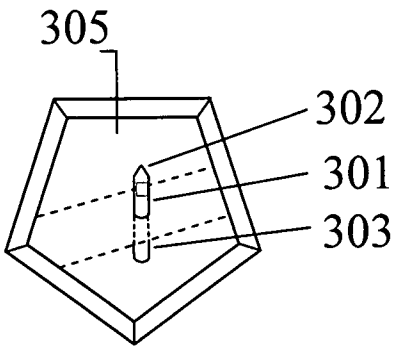
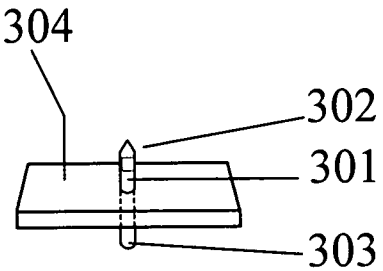
FIG. 3

Sensor and RFID tag Connection FIG. 9

AUTOMATIC LIFE ALARM

BACKGROUND

Field of the Invention

The present invention generally relates to wrist mounted life alarm dialers and more specifically, to devices with passive or non-conscious triggering of life saving requests for help in the event of user loss of consciousness.

From time to time life threatening events that occur from sudden loss of consciousness, to severe trauma and sudden paralysis or loss of strength, can render the victim with an inability to activate an alarm for help. While this is not always necessary when others are proximate and can act to save a life, this is not always the outcome and the consequences are permanent.

There are currently some solutions in the market place in the way of wrist phones and wearable wrist devices. These generally alert the user when their time has elapsed, timer types alarms, and can call multiple calling numbers. They also provide the capability for the user to communicate with the helping party through voice or text. But at the very moment that the user is supposed to push the button to trigger the alarm, if wearer becomes suddenly incapacitated, then the price can be infinite, as it could cost a life.

Hence what is needed are devices that have intelligence to alert rescue personnel upon user loss of capacity to act or move.

SUMMARY

The present invention discloses a very compact life alarm with a geodesic-like convex body frame structure mechanical sensor. The geodesic-like frame sensor has a plurality of polygonal frames with beveled edges which are contiguously coupled at their respective edges to facilitate mating to adjacent polygonal frames; beveled edge camber angles of each frame edge determined by the polygonal frame geometry to fit the frames contiguously about a geodesic or polyhedron center. Each frame has an exterior face and an interior face with face center normal intersecting at the geodesic-like frame structure center; an insulating strip attached from one edge of a frame to its opposite edge containing and aligned with the frame's center; an electrical conducting pin whose base extends out from the frame exterior face, through the strip and into the geodesic frame structure interior, the pin coupled with and normal to the insulating strip. An electrical connector from the pin base to an electronic timer circuit at times engages with an electrical conducting sphere free within the geodesic frame structure; an electrically ground geodesic frame electrically coupled to the opposite pole from the frame pins. A movement absent geodesic sensor channels the sphere by gravity to the geodesic sensor's lowest frame, in so doing causing the sphere to contact and connect the frame pin side circuit to the frame ground lead, energizing the electric timer circuit and the sensor wearer losing consciousness and unable to do the very minimum to call out for help would send a signal to appropriate preset rescue parties. The sensor can have various numbers of frames, but the preferred embodiments contain 12 or 36 pentagonal shaped frames or semi-sphere cup-like shape frames as well. A life alarm further comprising an electrical alarm circuit that after a first pre-set time period emits an aural alarm to the sensor wearer and a second alarm via wireless network to remote help.

BRIEF DESCRIPTION OF DRAWINGS

Specific embodiments of the invention will be described in detail with reference to the following figures.

FIG. 3 illustrates the plate-pin protrusion construction according to embodiments of the present invention.

DETAILED DESCRIPTION

Figure 1:
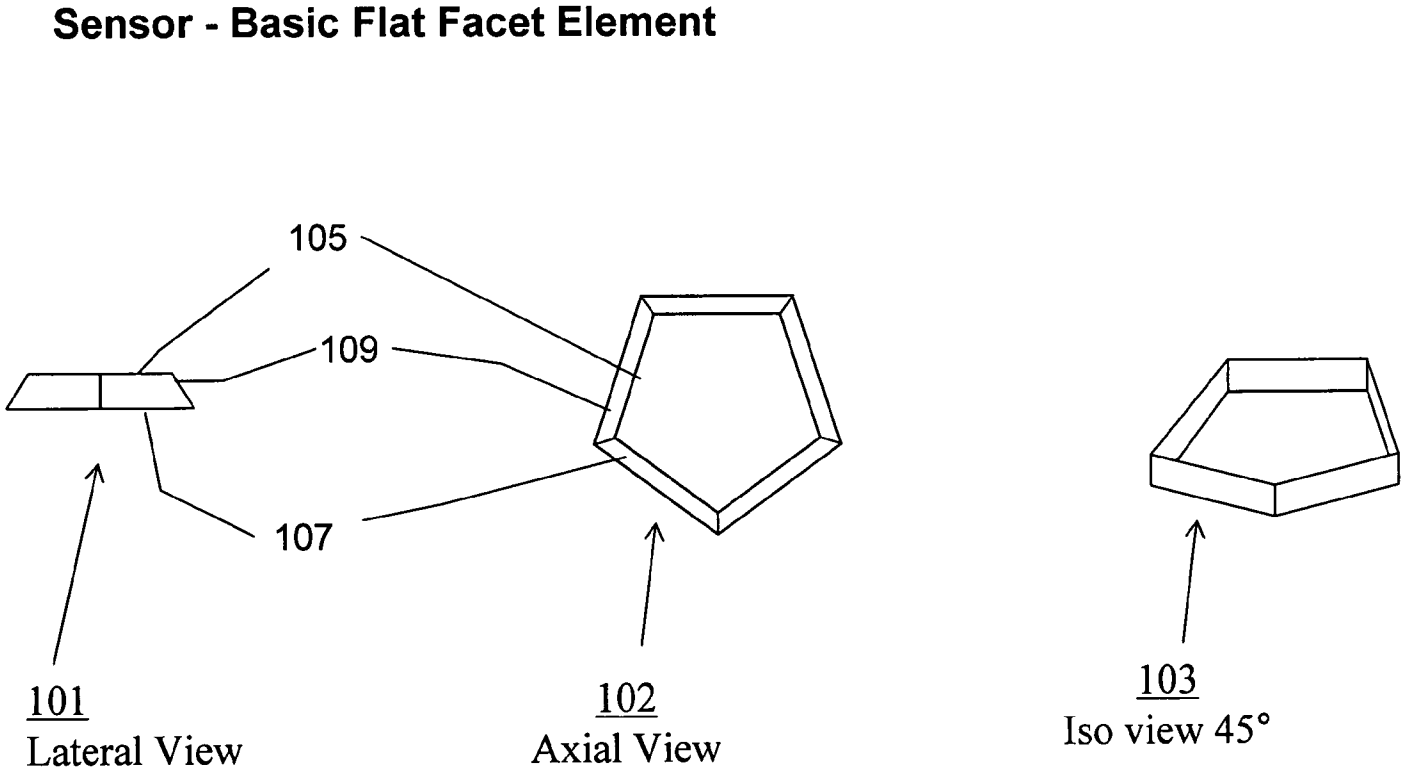
FIG. 1 illustrates the basic facet frame structure of conducting material comprising the mechanical geodesic sensor according to an embodiment of the present invention.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

OBJECTS AND ADVANTAGES

The present invention discloses an automated life alarm. Accordingly, it is an object of the present invention to use cessation of human movement for a preset designated duration as signal of a life in jeopardy.

Activity generally indicates signs of life. It is the observation of the applicant that the wrist of a human being is the most active external part of the human body, as far as voluntary muscles are concerned. During awake periods, absent medication or illness, the wrist of a human body intermittently makes some spontaneous movements. The cessation of such spontaneous movements, exceeding a given period of time, may represent a warning sign that something is wrong inside that body and needs attention. Under such a case, if a aural stimulus can not make that person to react, an alarm call should alert the appropriate parties.

Another object of the present invention is to have a timer switch in conjunction with a sensor wearer of a body sensor to process the positions sensed from a body movement or lack of movement. To determine that a wearer's wrist is not moving, one has to find that it has not changed position or orientation for a period of time. To determine a change or not of a body's physical movement, a mechanism through the body sensor is required to monitor a body's position and orientation continuously. Unchanged position periods exceeding a preset limit will automatically trigger an aural signal, urging the user of the life alarm sensor to make a movement toward a conscious response or emit a call for help.

Embodiments of the Invention

In an aspect of the invention, absence of physical movement from an individual wearing a body mechanical sensor is detected upon a circuit closing and staying closed for a given period. After a preset period an aural alarm is triggered, with a clock continuing to run. After a second preset period, a timer switch automatically triggers a wireless network or GSM autodialer to alert pre-designated parties.

In an embodiment of the invention, a body attached mechanical sensor is worn on the internal side of the wrist, the timer switch and the GSM autodialer is worn on the internal side at a length away to avoid any interference from the sensor.

In an embodiment of the invention, the mechanical sensor is a 3D geodesic shape comprised of polygonal or 3D geometrical frames coupled together via a beveled edges in such a geometrical manner as to provide a frame enclosed internal volume by the frames contiguously bound to their geometrically compliant bevel edge connected frame edge neighbors in a manner forming a geodesic frame or polyhedron type structure having an apparent internal volume or space, without complete surface bounding the volume, but the connected frames if filled with surfaces, would contain an enclosed volume.

FIG. 1 illustrates the basic facet frame structure of a mechanical geodesic sensor according to an embodiment of the present invention. In an embodiment of the invention the geodesic constructed of frames 109, lateral view 101, axial view 102 and isometric view 103, have a smaller inner frame edge 105 and larger outer frame edge 107 facet frame apparent surface. The edge is beveled such that frames 109 can be contiguously coupled to adjacent edge frames to form a spherical shape geodesic frame structure. In an embodiment of the frames 109 can be electrically conducting or non conducting depending on the type of circuit is used for a complete open-closed electrical path.

Figure 2:
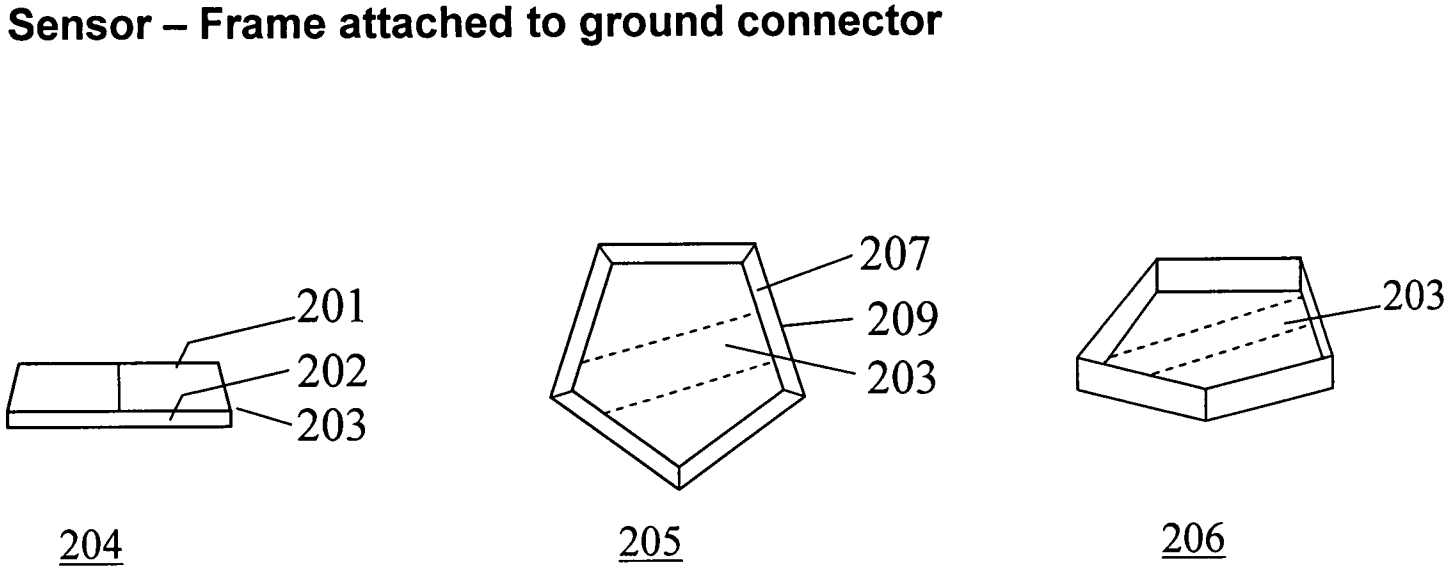
FIG. 2 illustrates the basic facet frame structure of non-conducting material comprising the mechanical geodesic sensor according to an embodiment of the present invention.

FIG. 2 illustrates the basic facet frame structure of non-conducting material comprising the mechanical geodesic sensor according in an embodiment of the present invention. A flat strip 203 with side edges 201 202, lateral view 204, axial view 205, and isometric view 206, of a non-conducting or insulating strip 203 is attached to the outer frame 207 surface 209 to insulate and support conducting pin on the frame.

FIG. 3 illustrates the frame-pin protrusion structure according to an embodiment of the present invention. A pin hole is made at the center of each plastic strip 304, and a conducting pin 301 is mounted on the strip 304 with the pin tip 302 pointed toward the geodesic internal volume and the pin tail 303 protruding from the plate 305 center outer surface.

Figure 4:
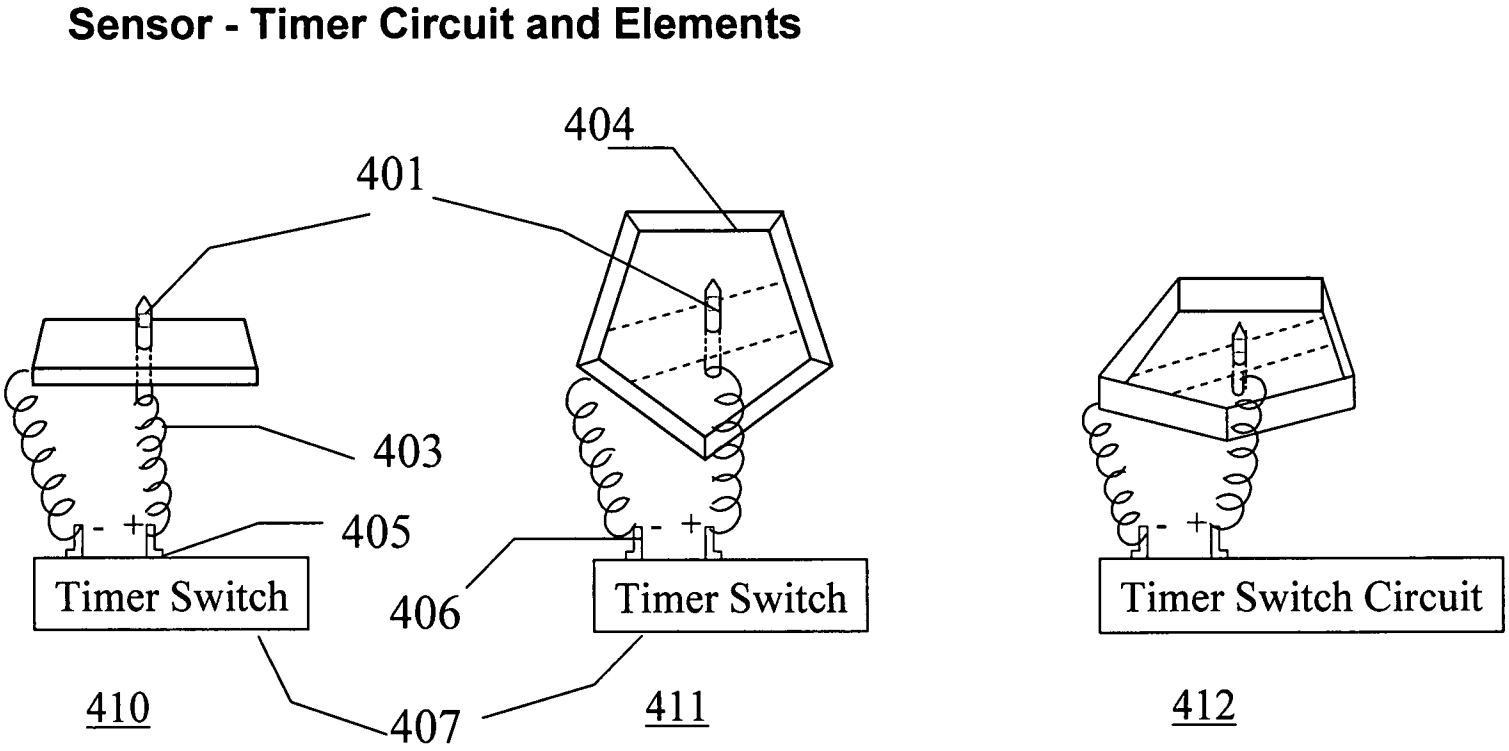
FIG. 4 illustrates the plate-pin timer switch circuits according to aspects of the present invention.

FIG. 4 illustrates the frame-plate-pin timer switch circuits according to and embodiment of the present invention. The tail of the pin 401 is electrically connected 403 to one of the positive (+) leads 405 of the timer switch 407, while the wall of the pentagonal frame 404 embodiment is coupled to all other pentagonal frames on their edges 404, and connected to the negative (−) lead 406 of the timer switch 407, acting as a ground lead. The strip 410 is shown coupled to the plate 411 in an isometric view 412.

Figure 5:
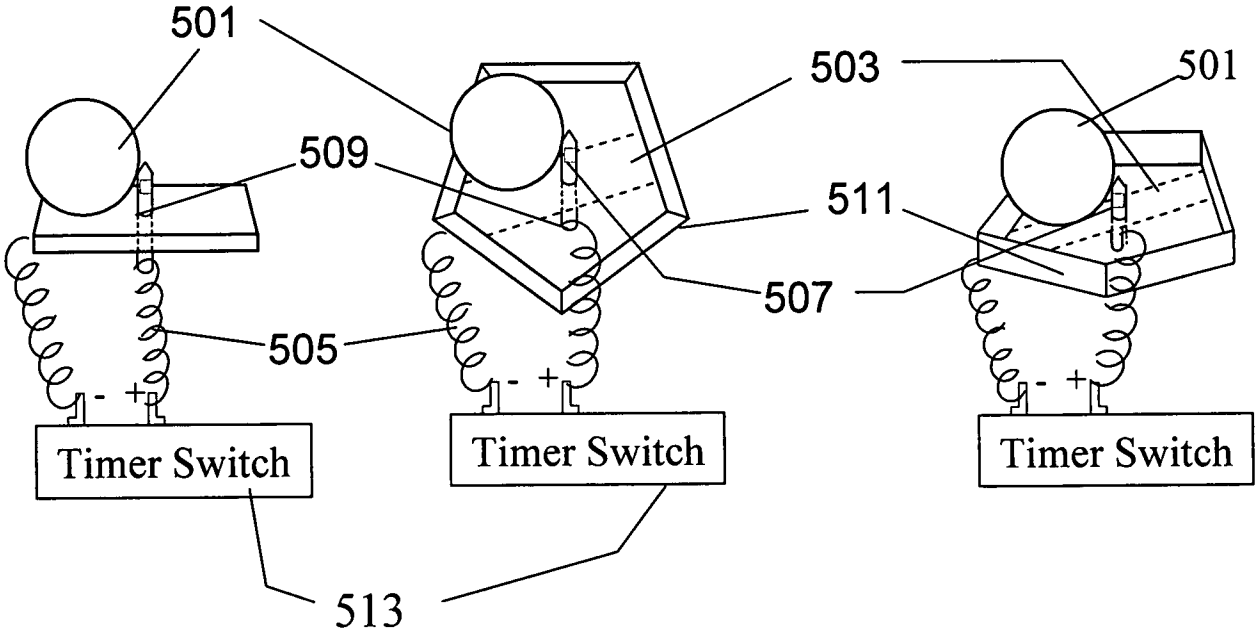
FIG. 5 illustrates the low plate seeking traveling spherical timer switch circuit connector according to aspects of the present invention.

FIG. 5 illustrates the free traveling lowest facet frame seeking spherical timer switch circuit connector element according to aspects of the present invention.

The rolling circuit connecter element is a conducting sphere 501. In the event that the sphere 501 falls onto the inner face of the conducting frame 503, it will electrically complete an electric circuit 505 by contact through the pin passing insulated through the plate wall 509, thus energizing the circuit between the plate pin 507 and the timer switch 513, allowing the timer switch 513 to signal that the sphere 501 is on a specific frame plate 511, a frame whose orientation is known because the frame plate's unique circuit 505 is energized.

Figure 6:
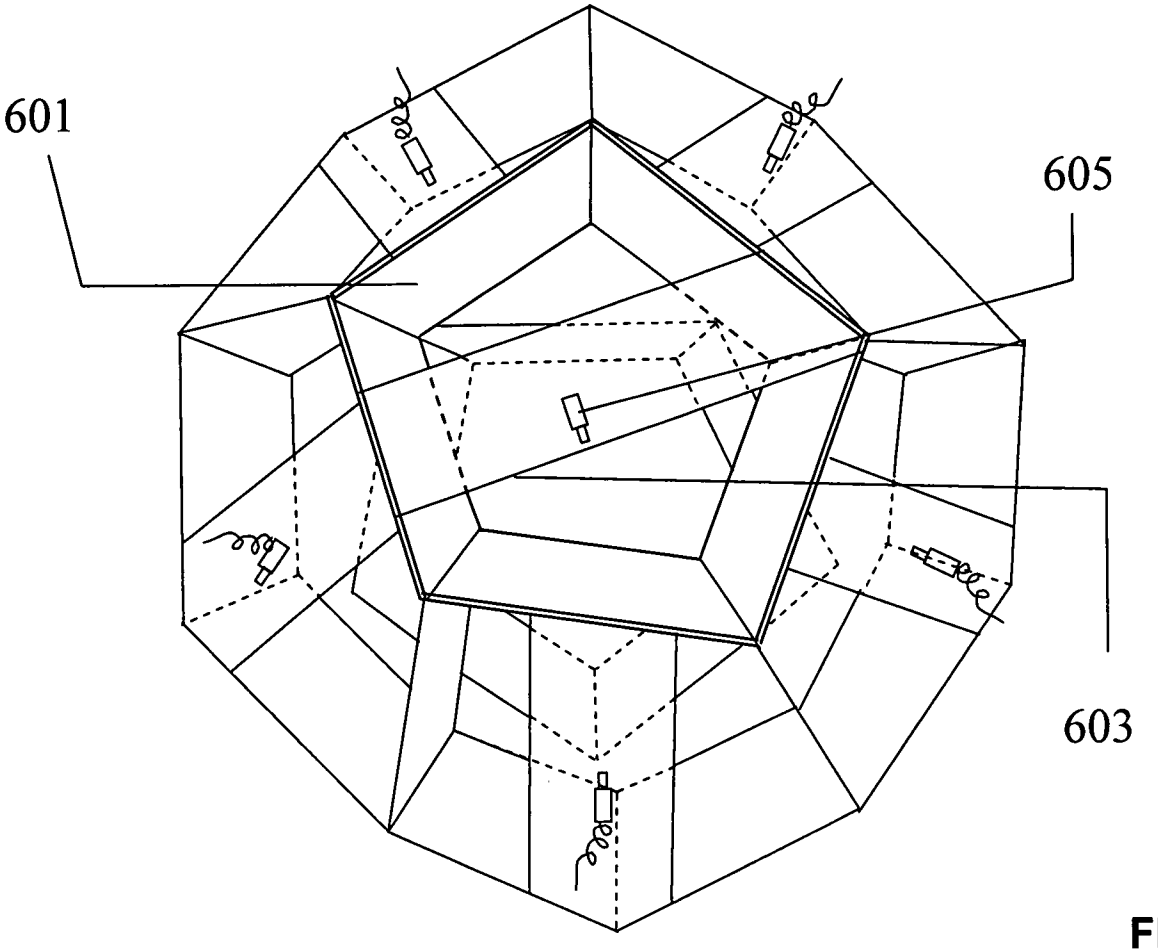
FIG. 6 illustrates an isometric external view of a 12 frame sensor according to embodiments of the present invention.

FIG. 6 illustrates an external view of a 12 frame sensor, a dodecahedron shape, according to embodiments of the present invention. The pentagonal frame wall 601 is coupled to other its neighboring frames on each beveled edge. Each frame contains a plate 603 which supports the electrical conduction pin 605 which is wired to an individual circuit with the frame 601 as ground. The geometrical coupling of 12 pentagonal frames symmetrically about a spherical center will create a geodesic spheroid bloc, with an interior volume having all plate pin tips pointing toward the center of the volume. Other combinations of polygons can be used for frames as well as combinations of different polygon frames can be used for more or less the same geodesic frame structure construction about a spatial center. Regular and irregular polyhedra such as an octahedron, icosahedron, dodecahedron, icosidodecahedron, also supply a convex polyhedron set of sensor structures that can be used for sensors as shown.

Figure 7:
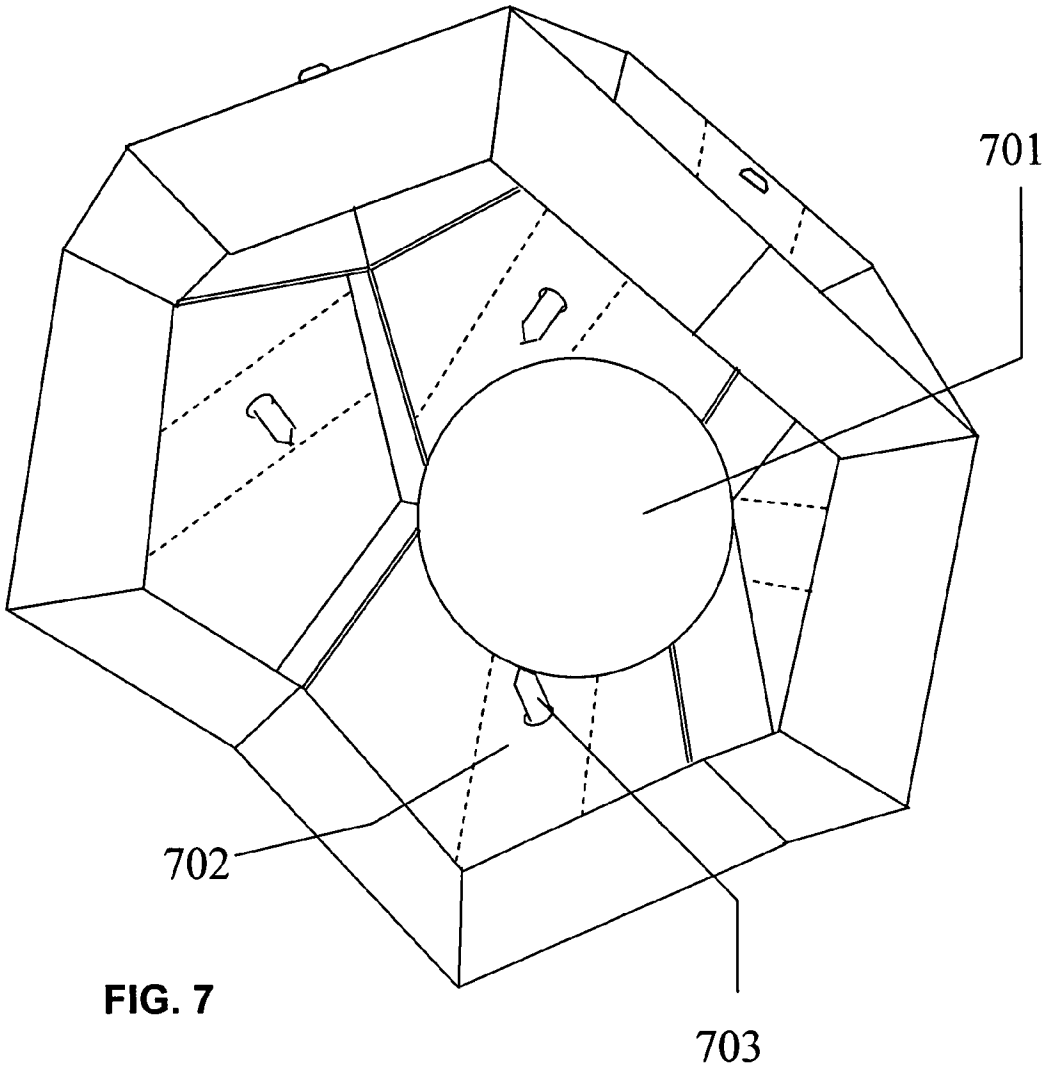
FIG. 7 shows a cross section isometric view of a 12 frame sensor with a conducting ball connecting the frame to a pin in accordance with an embodiments of the present invention.

FIG. 7 shows a isometric cross section view of a 12 frame sensor embodiment, dodecahedron shape from structure, configured about a center showing connector pins and internal conducting sphere connecting the frame to a pin in accordance with an embodiments of the present invention. A free conducting sphere 701 closes the frame 702 circuit when the sphere 701 touches the conducting pin 703. The 12 pentagonal frames coupled by their neighbor edges form a geodesic structure for the mechanical sensor. Under the influence of gravity, a pin 703 touching the conducting sphere 701 will be connected to one common (+) lead on the timer switch upon the conducting sphere settling in the lowest connecting plate touching pin of the geodesic.

Figure 8:
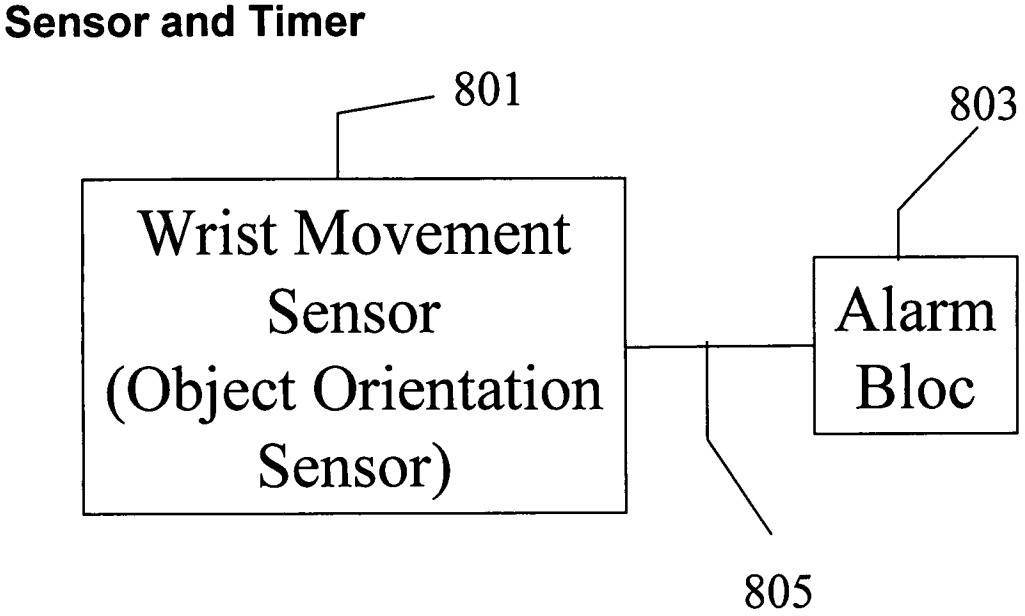
FIG. 8 shows a high level schematic diagram of an automatic life alarm in accordance with an embodiment of the present invention.

FIG. 8 shows a high level schematic diagram of an automatic life alarm in accordance with an embodiment of the present invention. A mechanical sensor attached to a wearer's wrist 801 capable of sensing cessation of movement and orientation of the final orientation, transmits a signal by wire or wireless 805 protocol to the alarm circuitry 803.

Figure 9:
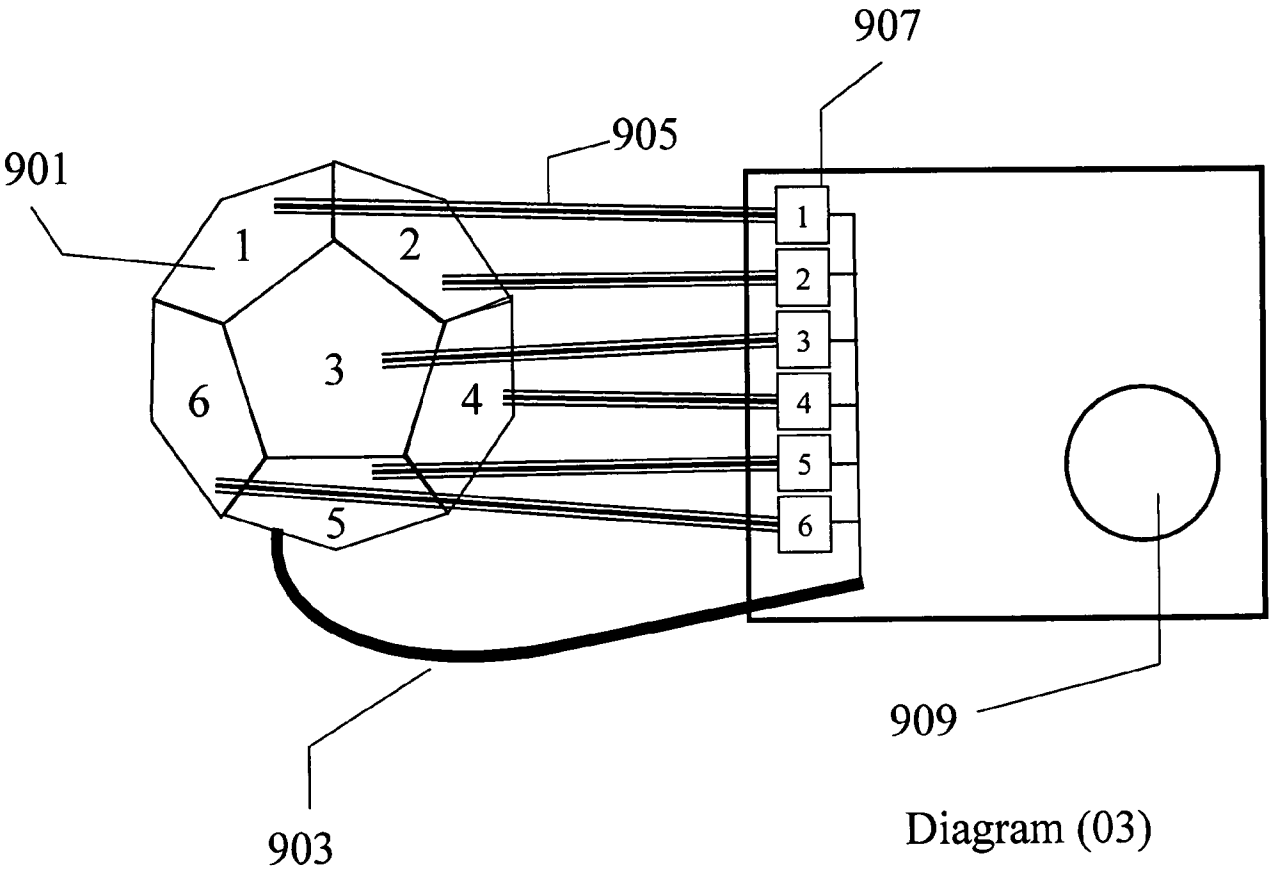
FIG. 9 illustrates a pentagonal frame dodecahedron mechanical sensor with alarm in accordance with an embodiment of the present invention

FIG. 9 illustrates a pentagonal frame dodecahedron structure mechanical sensor 901 with an alarm in accordance with an embodiment of the present invention. This embodiment contains 12 pentagonal frames in the mechanical sensor 901 and 6 positive leads 905 to the timer switch 907. An electrically conducting sphere freely rolling in the interior of the sensor closed convex geodesic interior from any movement of the wrist or wearer will position itself on the lowest frame. Upon cessation of body movement, the electrically conducting sphere will fall under gravity onto the lowest frames and make electrical circuit contact in one of 12 pentagonal frames, thus closing the circuit ground 903 of a particular frame and energizing the circuit and thus signal. The alarm circuit will require power 909 which can be battery or other compact available mobile power source.

From the time that the timer switch is closed to a preset wait period following the timer start, the timer will run and upon elapse of time emit an aural alarm. More than one preset time can be selected. In an embodiment of the invention, a first preset period can signal for the aural emission of a local sound alarm to awaken the user-wearer to make movement with the wrist. If upon the aural alarm the sphere continues to rest on the same plate, indicating no physical response from the user-wearer, the timer switch will initiate a Wireless Network autodialer for help from local parties, meanwhile transmitting the GPS position if available. Any wireless networks can be used including GSM, CDMA, TDMA, WiFi, and other wireless protocols.

The mechanical geodesic frame sensor can have different configurations of frames. A 36 frame sensor embodiment performs substantially the same as the 12 frame sensor, as to the free conducting sphere and connecting circuits. A manifest difference would be in the polygons chosen and the number of faces, the binding together of a mixture of pentagonal and hexagonal plates or frames and that the total number of frames to be 36 frames. The advantage of the 36 frame sensor is that it is more sensitive to small and slow movements of the wrist and better for less active individuals. The advantage of the cup shape sensor is its is quieter.

In yet another embodiment, the frames can be substituted for semi-spheres or cups, forming a the cup shaped sensor. The 12 metallic pentagonal plates have been replaced by 12 plastic cups which are bound together to form a globular-like shape. The interior of each cup is lined with two electrically conductive stripes, one peripheral stripe and one central stripe. All the peripheral stripes are connected together and wired to the ground lead of the timer switch. Two central stripes of opposite cups will be wired to one individual positive lead of the timer switch. So, they are 6 positive leads to go to 6 individual circuit positive leads of a timer switch. An electrical conducting sphere rolls inside the interior of the sensor globular shape interior. As the sphere drops and positions in one of the 12 cups, the conducting sphere will electrically connect the peripheral strip to the central strip, and by doing so, close the circuit between that cup and the timer switch.

Figure 10:
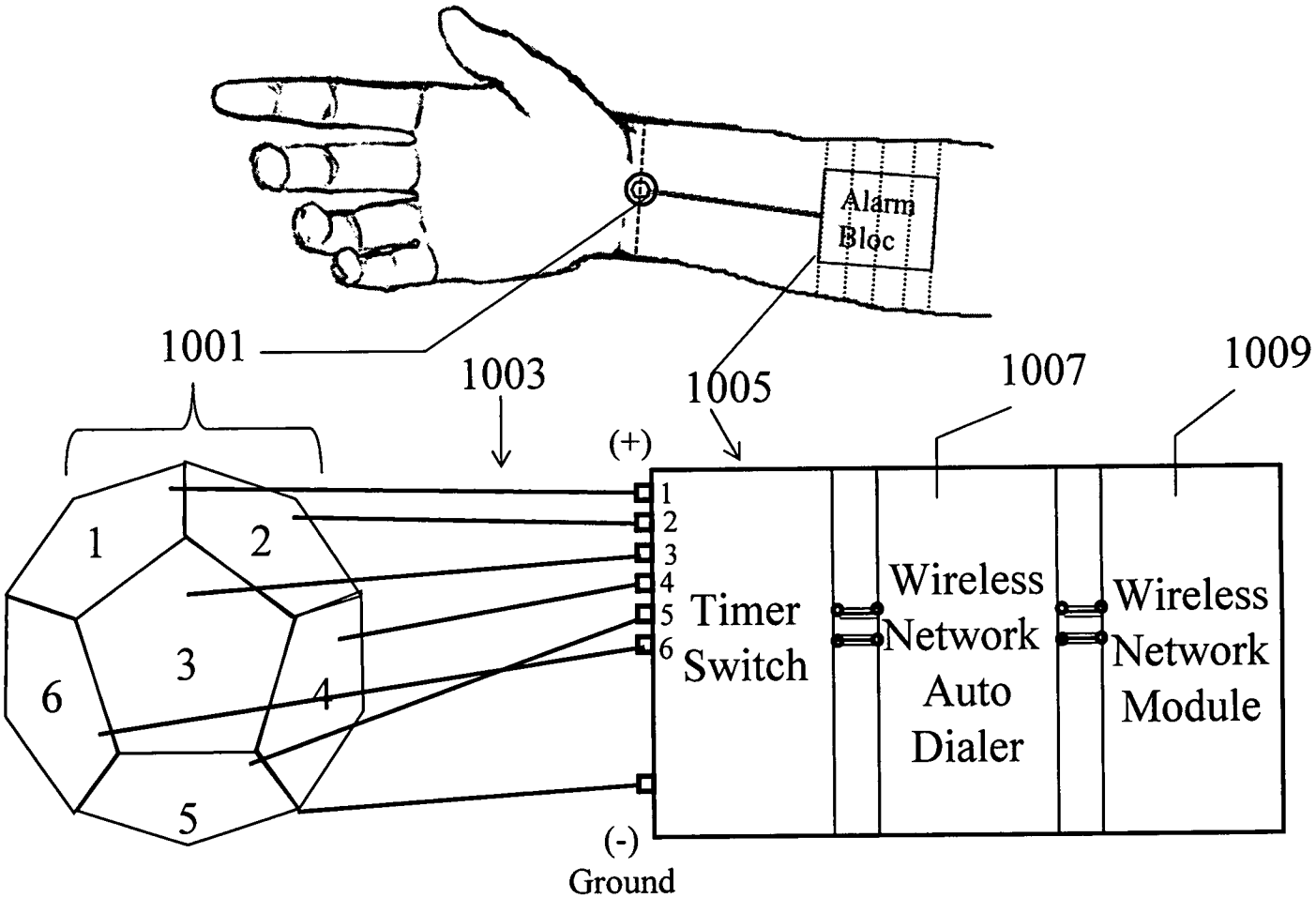
FIG. 10 illustrates a mechanical sensor attached to a wrist with alarm circuitry in accordance with an embodiment of the present invention.

FIG. 10 illustrates a wrist mounted dodecahedron geodisc sensor 1001 alarm circuitry 1005 in accordance with an embodiment of the present invention. Six leads 1003, one from each frame shown connects to the positive lead in the timer switch 1005 circuitry. The Alarm bloc contains the timer switch, wireless network autodialer 1007 and the wireless network module 1009 and is also shown worn on the user's wrist.

Figure 11:
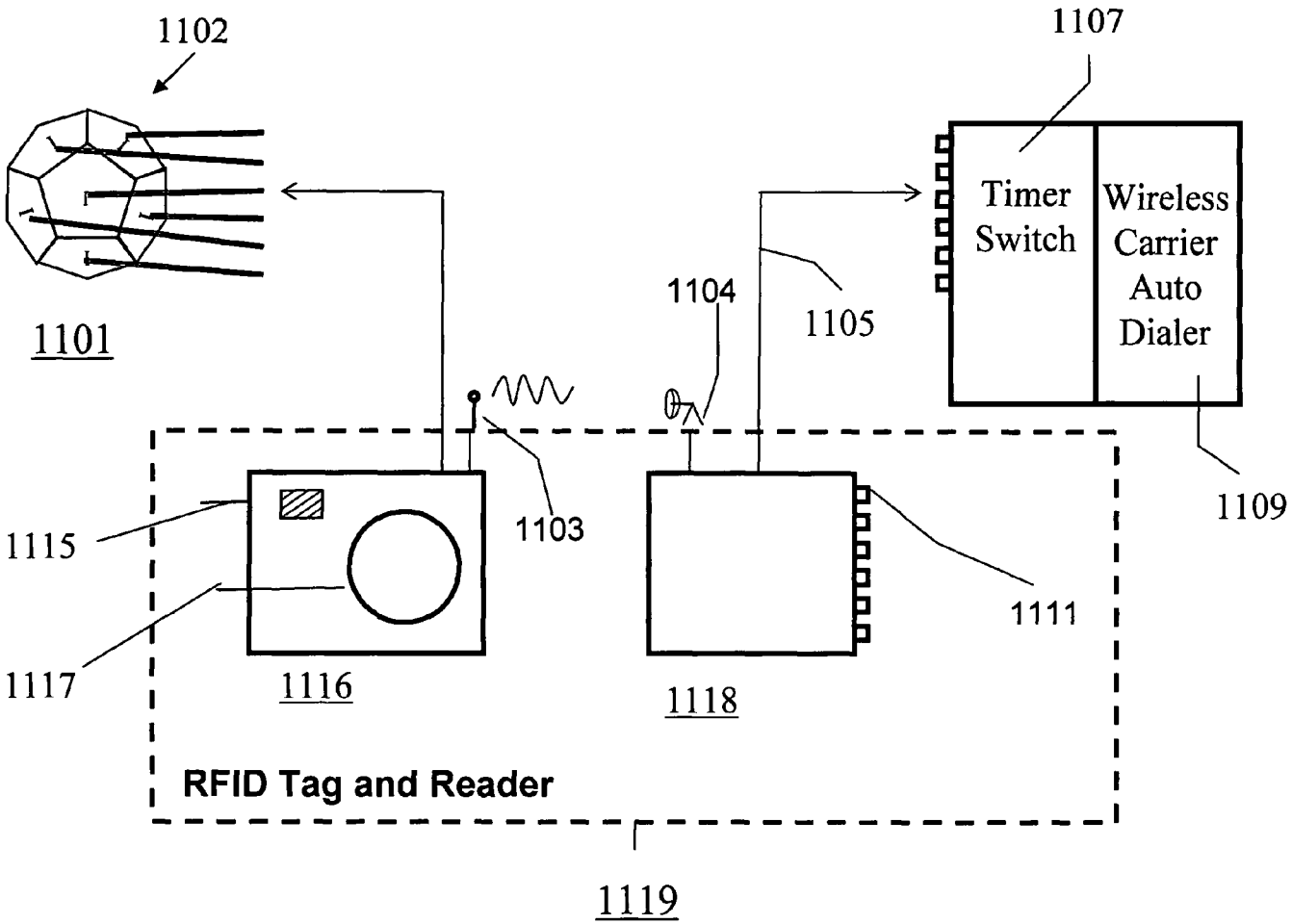
FIG. 11 illustrates a dodecahedron geodisc sensor with distributed alarm circuitry using RFID in accordance with an embodiment of the invention.

FIG. 11 illustrates a dodecahedron frame sensor 1011 with distributed alarm circuitry 1107 1109 using RFID 1119 in accordance with an embodiment of the invention. In this embodiment an RFID tag containing the chip 1115 and battery 1117 are operatively coupled 1103 to the sensor 1102 electrical circuitry. The RFID tag 1116 coupled 1103 1104 to the reader 1118 and reader 1118 to the timer 1107 can be of typical RFID communication 1105 or other wireless protocol. The six frame circuits shown is connected to six tags 1116 each of comprising a chip 1115 of a different frequency. Each frequency represents a unique frame and upon a frame circuit closing the energized circuit will respond to identify the frame and hence the sensor orientation. In another sensor orientation. In another embodiment the 6+Integrated Circuit (IC) chips can be integrated into one multiple interchangeable code RFID tag.

The circuit of each of the 6 IC chips is open, leaving exposed positive and negative ends. The negative ends of all the ICs are connected ground, to the negative lead of the sensor 1102, which is itself connected to all the peripheral strips. The positive leads are frequency matched to the reader 1118 each by frame to frequency 1111. The wrist movement of the sensor is disconnected from the timer switch though the RFID 1119 system, tag 1116 and reader 1118.

In the semi-sphere cup frame embodiment the positive lead of each IC is connected to the central strip of two cups opposite each other. As the conducting sphere or ball falls into one cup, it will lodge against the cup center pin and connect the ground strip thus closing the circuit between this cup and its mapped IC. If the Radio Frequency Identification (RFID) tag 1116 transmits a code frequency to the RFID reader, it will do so at the code frequency of the closed circuit IC revealing its cup and orientation. When the ball rolls into another cup, the tag 1116 will again emit the code frequency of its mapped cup and therefore orientation.

In an embodiment of the invention, the RFID reader 1118 is connected to the timer switch 1107. Each time the reader receives a code frequency 1111 from the tag 1116, it passes it to the timer switch 1107 for processing. The RFID tag 1116 is programmed to transmit a code frequency every 2 minutes to the timer switch 1107 which will receive a code frequency every 2 minutes from the reader 1118. The timer switch 1107 is programmed to count consecutive RFID reader transmissions, and counting the same frequency code 7 consecutive times indicates that the same cup, has had the ball for 14 minutes.

This indicates body sensor inactivity and inactivity directs the alarm to emit a loud aural signal to alert the user to move. If the timer switch 1107 receives the same frequency code the $8^{th}$ time, that means 16 minutes of no movement of the wrist, the timer switch 1107 will trigger the wireless carrier autodialer 1109 to alert a monitoring room and rescue or emergency responder parties.

Figure 12:
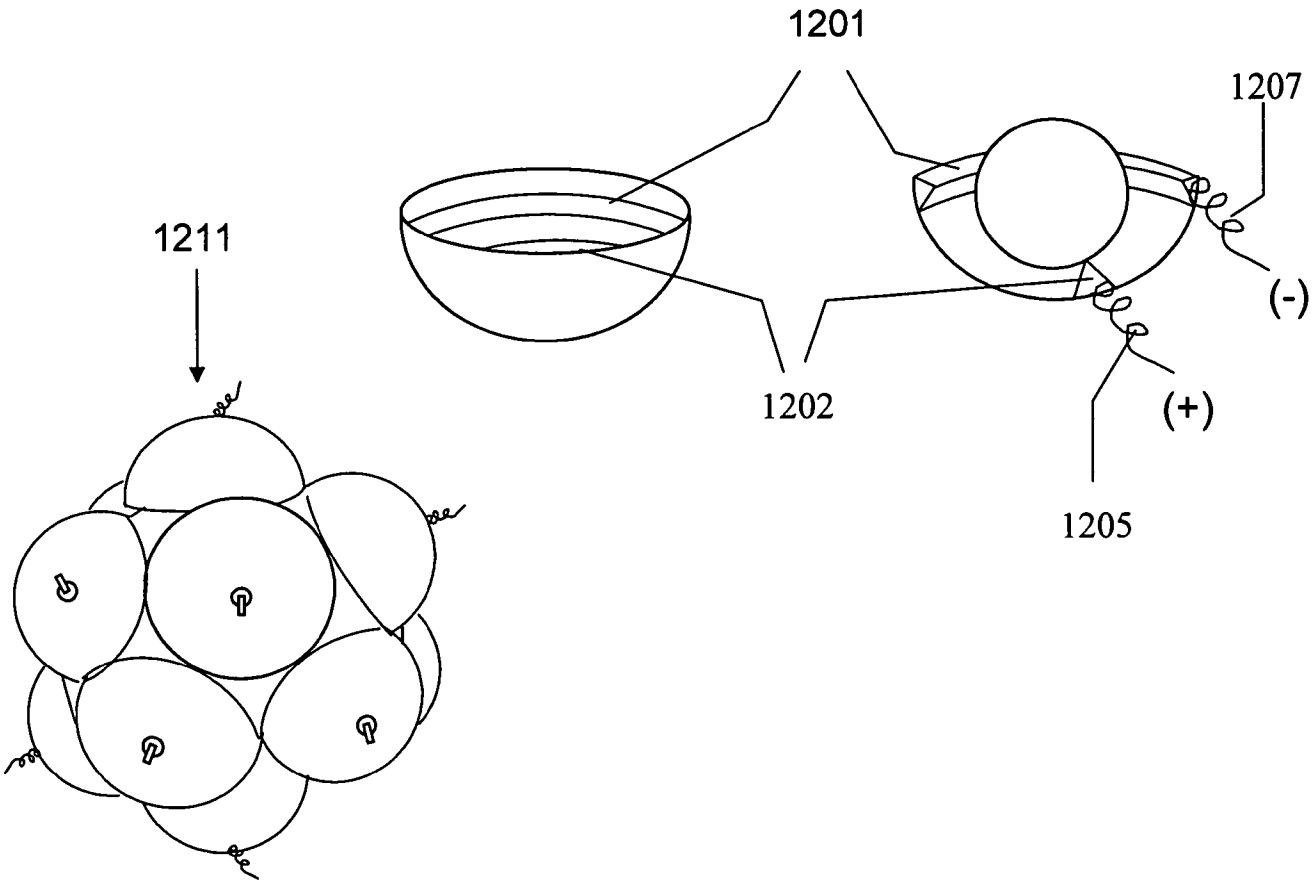
FIG. 12 illustrates a 12 cup "dodecahedron" mechanical sensor in accordance with an embodiment of the present invention.

FIG. 12 illustrates a 12 semi-sphere "cup frame" dodecahedron-like mechanical sensor 1211 in accordance with an embodiment of the present invention. This embodiment is made up of 12 plastic cups composing coupled at their respective neighbor edges forming the exterior of the mechanical sensor in the shape of a globe. The interior of each plastic cup is lined with two electrically conductive strips, one on the cup edge periphery 1201 and the other towards the center of the cup 1202. All of these edge periphery strips 1201 are connected to each other cup edge and serve as the ground 1207 negative lead. Six positive leads 1211 shown are connected to the timer switch positive lead. An electrically conducting sphere freely rolling in the interior of the globular cup sensor from any movement of the wrist or wearer will position itself on the lowest cup, connect the positive 1205 and ground 1207 strips, and trigger a closed circuit.

Figure 13:
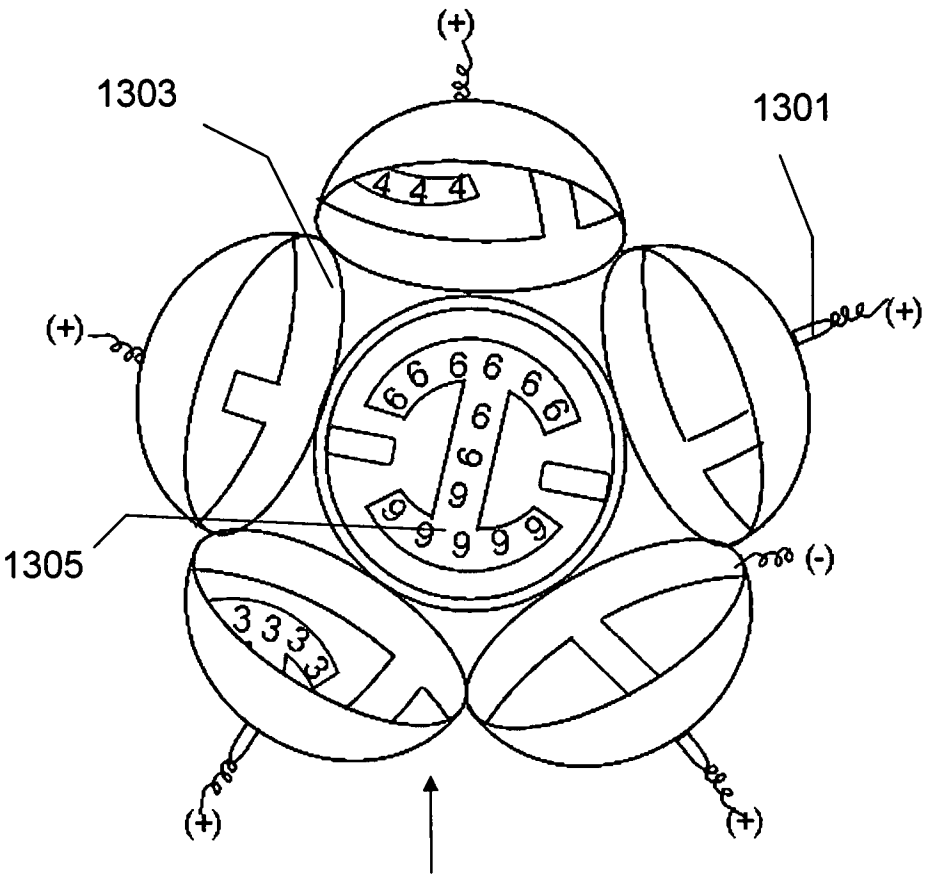
FIG. 13 a cross section view of a 12 cup "dodecahedron" mechanical sensor in accordance with an embodiment of the present invention.

FIG. 13 a cross section view of a 12 cup "dodecahedron" mechanical sensor 1311 in accordance with an embodiment of the present invention. The positive lead 1301 attaches to a conducting pin which extends toward the sensor interior center. The negative lead is a conducting strip along the edge 1303 of all the cups and are connected to the negative lead. Two cups or frames of opposite globe positions can be connected to form half the number of orientations and hence only require have the orientation signals. The circuit RFID frequency is shown on the positive strip 1305.

Figure 14:
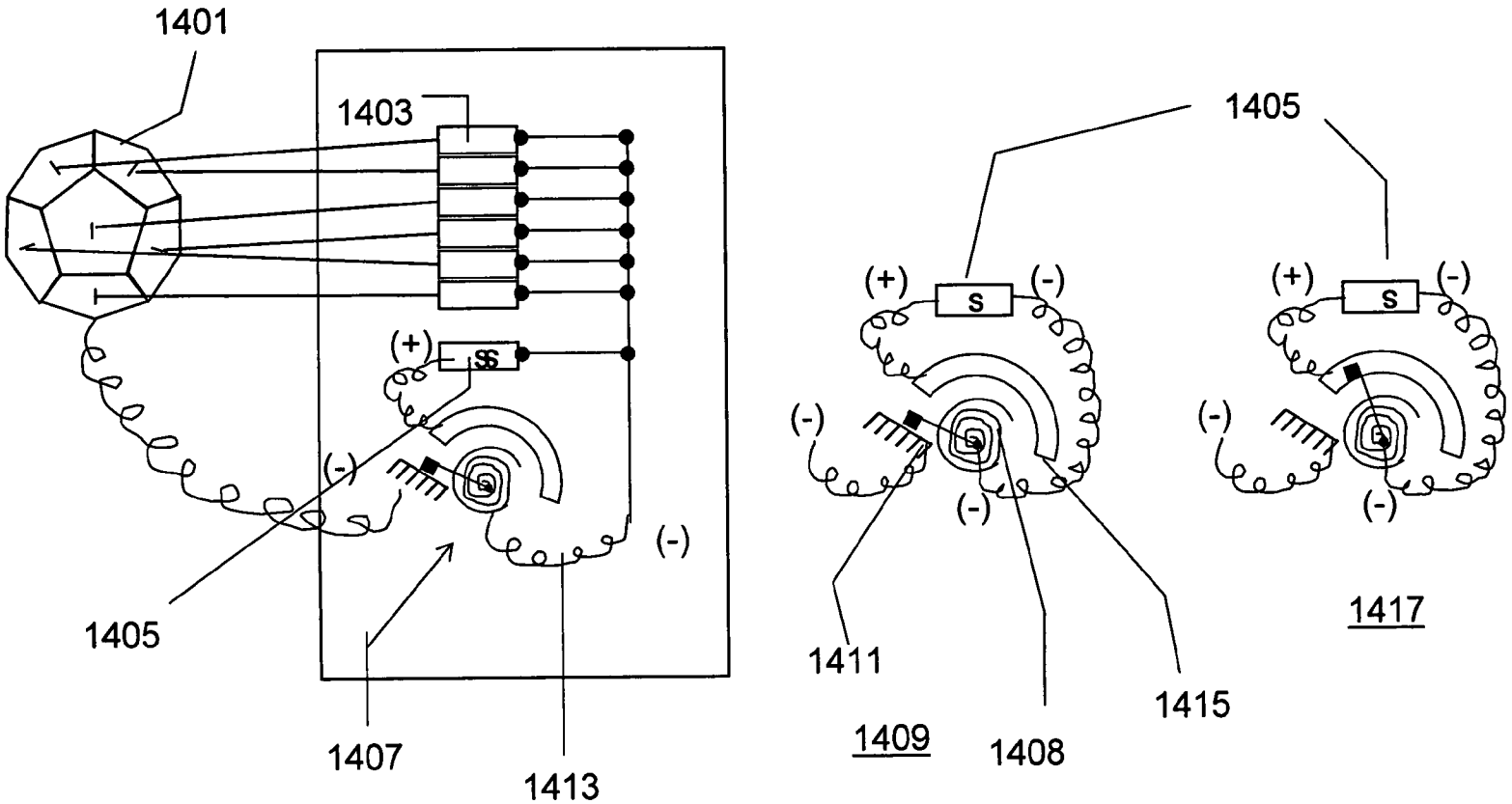
FIG. 14 illustrates a dodecahedron-like globular sensor with distributed alarm circuitry using RFID in accordance with an embodiment of the invention.

FIG. 14 illustrates a dodecahedron-like globular sensor with distributed alarm circuitry using RFID in accordance with an embodiment of the invention. For sleep mode a seventh IC 1405 is added to the RFID tag 1403 and remains active with a DELAY SPRING ON/OFF SWITCH 1407. The connection between this delay ON/OFF switch 1409 and the $7^{th}$ IC 1405, activated only for sleep mode, and the negative lead 1413 of the IC tag 1403 sensor 1401 is in such a way that when the $7^{th}$ IC 1405 sleep mode is on, the spring 1408 on the delay switch 1409 is turned 1411, all the circuits to the sensor are off and vice versa. The spring 1408 in contact to the negative side 1411 of the tag, the time the frequency code of the sleep IC, the $7^{th}$ IC 1407, is transmitted to the timer switch, signaling that the function of triggering the Wireless Network Carrier autodialer to send the alarm is temporary disconnected. The user sets the time for the sleep by turning the DELAY SPRING ON/OFF SWITCH 1407 to off, negative lead 1411 or in contact to the tag positive lead 1415 shown in 1417.

An embodiment of the invention in a preferred mode comprises a plurality of geometrical frames with beveled edges which are contiguously coupled to facilitate mating to adjacent edge frames; the beveled edge camber angles of each frame are determined by the polygonal frame geometry to fit the frames contiguously about a geodesic center; with each sensor frame having an exterior face and an interior face with face center normal intersecting at the geodesic-like frame structure center; an insulating strip attached from one edge of a frame to its opposite edge containing and aligned with the frame's center; an electrical conducting pin whose base extends out from the frame exterior face, through a frame strip and into the geodesic frame structure interior, the pin coupled with and normal to the insulating strip; an electrical signal connection from the pin base to an electronic timer circuit; an electrically ground geodesic frame electrically coupled to the opposite pole from the frame pins, and an electrical conducting sphere free within the geodesic frame structure; a movement absent geodesic settling the conducting sphere by gravity to the geodesic frame sensor's lowest frame, in so doing causing the sphere to contact and connect the frame pin side circuit to the frame ground lead, energizing the frame circuit and signaling to a timer circuit that the frame circuit closed; the timer circuit receiving sensor signal incrementing a circuit specific timer, comparing the time with internal clock pre-sets time periods for each circuit, and a wireless network auto dialer coupled to the alarm timer with component wireless network module and GPS sensor; which upon timer reaching pre-set time periods without interruption from other sensor signals, the timer issues an alarm and signal for help from preset parties.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A wrist life alarm with a geodesic-like frame structure mechanical sensor comprising:

a plurality of geometrical frames with beveled edges which are contiguously coupled to facilitate mating to adjacent edge frames;

the beveled edge camber angles of each frame are determined by the polygonal frame geometry to fit the frames contiguously about a geodesic center;

each sensor frame having an exterior face and an interior face with face center normal intersecting at the geodesic-like frame structure center;

an insulating strip attached from one edge of a frame to its opposite edge containing and aligned with the frame's center;

an electrical conducting pin whose base extends out from the frame exterior face, through a frame strip and into the geodesic frame structure interior, the pin coupled with and normal to the insulating strip;

an electrical signal connection from the pin base to an electronic timer circuit;

an electrically ground geodesic frame electrically coupled to the opposite pole from the frame pins, and an electrical conducting sphere free within the geodesic frame structure;

a movement absent geodesic settling the conducting sphere by gravity to the geodesic frame sensor's lowest frame, in so doing causing the sphere to contact and connect the frame pin side circuit to the frame ground lead, energizing the frame circuit and signaling to a timer circuit that the frame circuit closed;

the timer circuit receiving sensor signal incrementing a circuit specific timer, comparing the time with internal clock pre-sets time periods for each circuit;

a wireless network auto dialer coupled to the alarm timer with component wireless network module and GPS sensor;

upon timer reaching pre-set time periods without interruption from other sensor signals, the timer issues an alarm and signal for help from preset parties, whereby the sensor wearer losing consciousness and unable to do the very minimum to call out for help would still send a signal to appropriate preset rescue parties.

2. A wrist life alarm sensor of claim 1, wherein there are 12 pentagonal shaped frames arranged as a dodecahedron frame structure.

3. A wrist life alarm sensor of claim 1, wherein there are 36 pentagonal shaped frames comprising the sensor structure.

4. A wrist life alarm sensor of claim 1, wherein there are 12 semi-sphere cup shaped frames each having a positive and negative lead strip whose circuit is energized by the conducting sphere.

5. A wrist life alarm sensor of claim 1, further comprising an electrical alarm circuit which emits an aural alarm to the sensor wearer upon timer reaching a first pre-set time period.

6. A wrist life alarm sensor of claim 1, further comprising an electrical alarm circuit and component GPS sensor and autodialer, after a second pre-set time period, triggers an autodialer call for help to preset parties and sends GPS location and other rescue information via a wireless network.

7. A wrist life alarm sensor of claim 1, further comprising RFID tags emitting signals to an RFID reader coupled to the alarm circuit, upon sensor circuit energizing the RFID tags and causing the alarm circuit to receive the signal.

8. A wrist life alarm sensor of claim 1, further comprising and an added frame circuit RFID tag which upon manual selection, turns off all individual sensor frame circuits for a wearer sleep mode.

* * * * *